United States Patent [19]

Rabas et al.

[11] Patent Number: 4,458,874

[45] Date of Patent: Jul. 10, 1984

[54] ADJUSTABLE MERCHANDISE DISPLAY DEVICE WITH SECURING MEANS

[75] Inventors: Kenneth J. Rabas, Waukesha; Daniel J. Pappas, Glendale, both of Wis.

[73] Assignee: SCI Marketing, Milwaukee, Wis.

[21] Appl. No.: 462,352

[22] Filed: Jan. 31, 1983

Related U.S. Application Data

[63] Continuation of Ser. No. 180,089, Aug. 21, 1980, abandoned.

[51] Int. Cl.[3] ..... A47B 97/04

[52] U.S. Cl. ..... 248/670; 248/448

[58] Field of Search ..... 248/670, 451, 448, 449, 248/310, 172; 211/43, 184

[56] References Cited

U.S. PATENT DOCUMENTS

| | | | |
|---|---|---|---|
| 1,780,872 | 11/1930 | Dumben | 211/43 |
| 2,419,721 | 4/1947 | Kopp | 211/43 |
| 3,176,947 | 4/1965 | Inverso | 248/448 |
| 3,425,565 | 2/1969 | Sprenger | 211/43 |
| 3,487,945 | 1/1970 | Barham | 211/43 |
| 3,895,768 | 7/1975 | Scheck | 248/310 |
| 4,066,168 | 1/1978 | O'Toole et al. | 248/451 |

*Primary Examiner*—William H. Schultz
*Assistant Examiner*—Ramon O. Ramirez

[57] ABSTRACT

A merchandise display rack as disclosed of the type for supporting merchandise and for securing the merchandise against removal. The display rack includes a base including an upwardly and rearwardly sloping display deck, the deck including at least one groove having opposed sidewalls and a bottom wall. Also included are a pair of bracket members disposed in opposed spaced relation and adapted to clampingly engage a display item therebetween, the pair of bracket members including a first bracket member having a first portion adapted to be housed in the groove and a merchandise item engaging portion, and a second bracket member including a slide portion housed in the groove for selective movement in the groove toward and away from the first bracket member and a merchandise item engaging portion, the second bracket being adjustably slideably movable into clamping engagement with the merchandise item, the second bracket member being movable to accommodate products of various sizes and shapes.

4 Claims, 4 Drawing Figures

ADJUSTABLE MERCHANDISE DISPLAY DEVICE WITH SECURING MEANS

This application is a continuation of application Ser. No. 180,089, filed Aug. 29, 1980, now abandoned.

FIELD OF THE INVENTION

The invention relates to display racks for use in supporting and displaying merchandise and more particularly to a display rack for use in displaying consumer products such as calculators, watches, jewelry and the like and for supporting these products such that they can not be easily removed from the display rack.

BACKGROUND OF THE INVENTION

Merchandise display devices for use in displaying consumer items such as calculators and the like should be constructed such that the products are displayed in a manner which permits inspection and or operation of the products by the consumer yet prevents removal or theft of the products. The display device should also be designed so as to be attractive to the consumer and so as to display the product in a manner maximizing sales. It is also preferable that the display device should be constructed such that it can be employed to display a wide variety of different products. Additionally, the display device should be relatively inexpensive to manufacture.

SUMMARY OF THE INVENTION

The invention includes merchandise display rack for supporting merchandise and for securing the merchandise against removal, the display rack comprising a base including an upwardly and rearwardly sloping display deck including at least one groove having a bottom wall, and means for supporting the deck. Means are also provided for securing merchandise to the display surface including a pair of bracket members disposed in opposed spaced relation and adapted to clampingly engage a display item therebetween. The bracket members include a first bracket member having a first portion adapted to be housed in the groove and a merchandise item engaging portion. A second bracket member includes a slide portion also housed in the groove for selective movement in the groove toward and away from the first bracket member and a merchandise item engaging portion. Means are also provided for securing one of the bracket members against movement, and for releasably securing the second bracket member to the base.

One of the principal features of the invention is the provision in at least one of the bracket members of an end wall extending upwardly from the slide portion and a lip projecting from the upper end of the end wall toward the other of the bracket members.

Various other features and advantages of the invention are set forth in the following description, in the claims and in the drawings.

Figure 1:
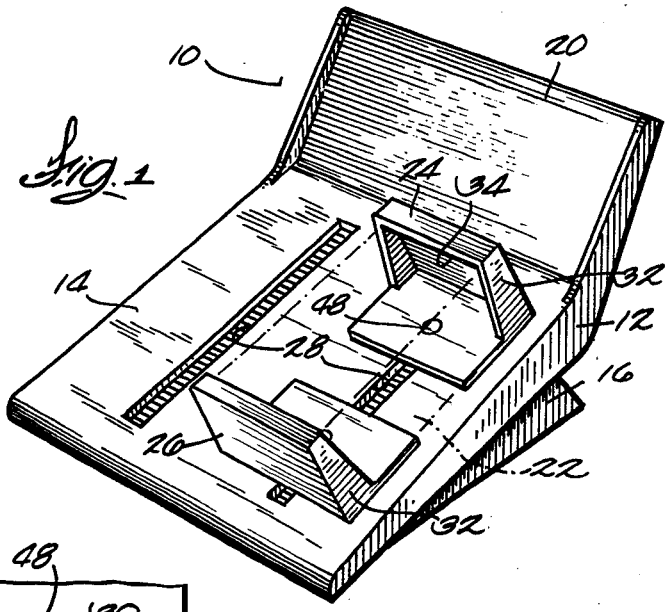
FIG. 1 is a perspective view of a display rack embodying the invention.
Figure 3:
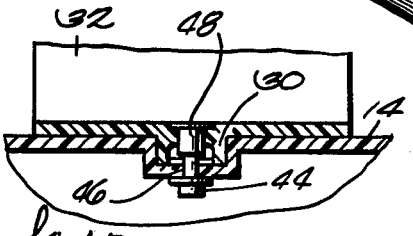
FIG. 3 is a cross section view taken along line 3—3 in FIG. 2.
Figure 2:
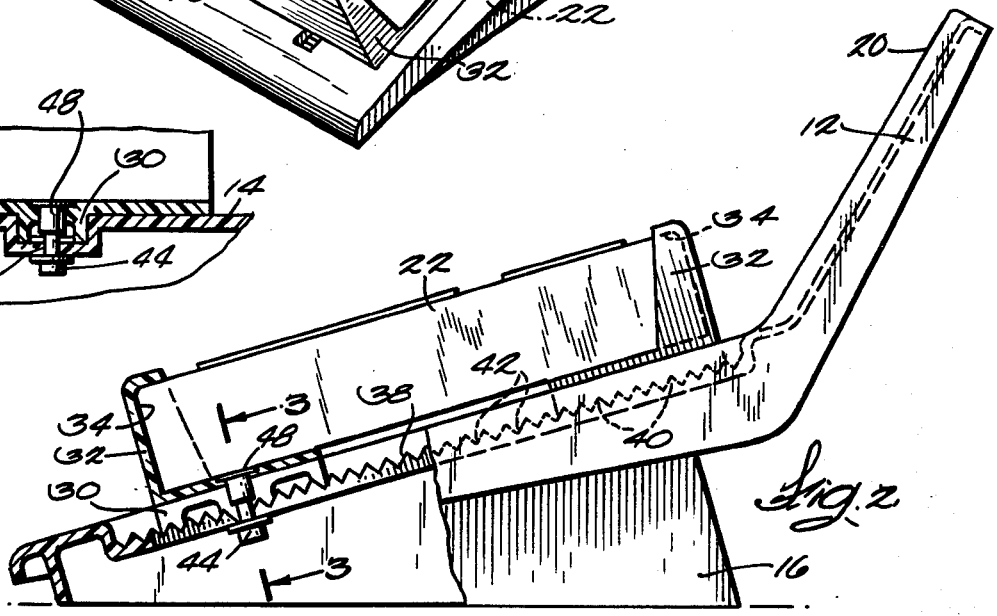
FIG. 2 is an enlarged cross section elevation view of the display rack shown in FIG. 1.
Figure 4:
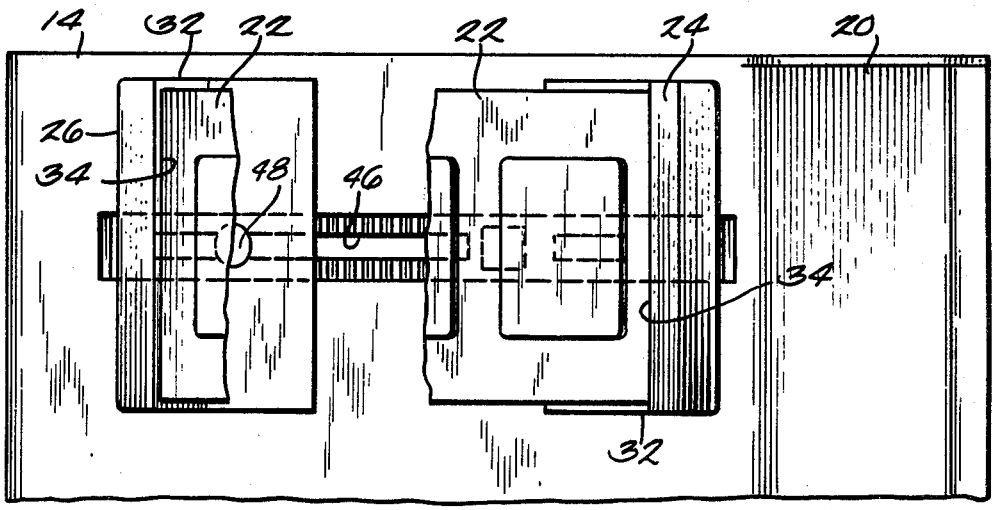
FIG. 4 is an enlarged partial plan view of the display rack shown in FIG. 1.

Before describing at least one embodiment of the invention in detail, it is to be understood that the invention is not limited in its application to the details of construction nor to the arrangement of the components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

DESCRIPTION OF A PREFERRED EMBODIMENT

Illustrated in the drawings is a display rack 10 for use in retail merchandising of products such as calculators and a wide variety of other consumer items. The display rack is comprised of a self-supporting base member 12 including a generally planar upwardly and rearwardly inclined merchandise supporting surface 14, the supporting surface 14 being supported by a pair of legs 16. In one preferred embodiment of the invention, the supporting base 12 is conveniently constructed from a durable and attractive molded plastic. In the illustrated construction, the self-supporting base 12 also includes a display surface 20 extending upwardly from the rearward portion of the supporting surface 14, the display surface 20 being adapted to support signs or other advertising. For example, the display surface 20 is particularly adapted to support self-adhesive display labels of the type advertising the product supported by the display rack 10.

Means are also provided for securing display merchandise or products 22 (shown in phantom) to the upwardly and rearwardly inclined supporting surface 14, such means including at least a pair of brackets 24 and 26 adapted to engage opposite ends of the display item 22, and means for securing the brackets 24 and 26 to the supporting surface 14. In the illustrated construction, the supporting surface 14 includes a pair of spaced apart parallel linear grooves 28, each of the grooves 28 extending from a generally forward portion of the supporting surface 14 rearwardly to the rearward portion of the supporting surface. Each of the grooves 28 is adapted to support a pair of opposed brackets 24 and 26 in such a manner that the brackets can be selectively slideably moved in the grooves toward and away from each other.

The pairs of brackets 24 and 26 are constructed so as to engage opposite sides or ends of the product 22 being displayed and such that the product is supported for inspection or operation by the consumer but in a manner that the product can not be removed from the display device 10. In the illustrated construction, the brackets 24 and 26 each include a slide portion 30 adapted to be slideably housed in the groove 28 in the supporting surface and the slide portion 30 supports a housing 32, the housing 32 being shaped to encase an end portion of the product 22 to be displayed. In the illustrated construction, the housing portion 32 of the bracket 24 is adapted to receive one end of a hand held calculator 22, the housing 32 including a rectangular opening 34 having a size and shape complementary to that of the calculator such that the calculator can be slideably inserted into the opening 34 of the housing. The other bracket 26 similarly includes a housing portion 32 which has an opening 34 of a size and shape particularly adapted to receive an opposite end of the calculator 22.

Means are also provided for securing the brackets 24 and 26 in the desired selected positions in the grooves 28 such that the spaced apart brackets clampingly engage the opposite ends of the product 22 and such that the brackets 24 and 26 can not be removed from the grooves 28. In the illustrated construction, the floor 38 of each groove 28 is serrated or ribbed, i.e. the floor of the groove is defined by transversely extending ribs or ridges 40, and the lower surfaces of the slide portions 30 of the brackets 24 and 26 are similarly provided with complementary transverse ribs 42 such that, when the slide portions 30 of the brackets are housed in the grooves 28, the transverse ribs 40 and 42 of the respective groove and the bracket are positioned in mating engagement and prevent slideable movement of the bracket in the longitudinal direction of the groove 28.

The securing means also includes a screw 44 which extends upwardly through a longitudinal slot 46 in the floor of the groove 28 and is threadably received in a threaded insert 48 embedded in the bracket 24 or 26. In one embodiment of the invention, each of the brackets can be secured in place by screws 44 extending through slots 46 in the floor of the grooves 28. In other embodiments of the invention, one of the brackets 24 and 26 may be secured by adhesive to the supporting surface 14 of the supporting base member. In other alternative embodiments of the invention, one of the brackets 24 and 26 can be an integral molded part of the supporting base member 12.

While the brackets 24 and 26 illustrated in the drawing are shown as having a construction which will receive opposite ends of a calculator 22 and thereby clamp the calculator to the supporting base member, in other embodiments of the invention, the configuration of the brackets can be such that they will engage a variety of other types of consumer products. If it is desired to employ the supporting base member for use in supporting other products, the the screws 44 are removed and alternative brackets for use in supporting other products can replace the brackets shown in the drawings.

While in the illustrated construction the display device is shown as being adapted to support two products in side-by-side relation, in still other embodiments of the invention the display rack can also be used to support a single relatively large display item and wherein the bracket members for use in holding that display item each include a pair of parallel legs 30 which are spaced apart appropriately to be received in the spaced apart parallel grooves 28.

Various features of the invention are set forth in the following claims.

We claim:

1. A merchandise display rack for supporting a merchandise item and for securing the merchandise item against removal, the display rack comprising a base including a deck surface, said deck surface being inclined upwardly and rearwardly, said surface including at least one groove having opposed sidewalls and a bottom wall, and means for securing the merchandise item to said base including a pair of bracket members positioned in opposed spaced apart relation on said deck surface, said pair of bracket members including a first bracket member adapted to house one portion of the merchandise item, said first bracket member including a slide portion housed in said groove so as to be selectively slideably movable along the length of said groove, a housing portion supported by said slide portion and adapted to slide along said deck surface, said housing portion including a cavity for housing a portion of the merchandise item supported by the display rack, and means for selectively securing said first bracket member to said base to prevent movement of said first bracket member along the length of said groove, a second bracket member adapted to house a second portion of said merchandise item, said second bracket member including a second slide portion housed in said groove so as to be selectively slideably moveable along the length of said groove toward and away from said first bracket member, a second housing portion supported by said second slide portion and adapted to slide along said deck surface, said second housing portion including a cavity for housing the second portion of the merchandise item, and means for selectively clamping said second bracket member to said base to prevent slideable movement of said second bracket member in said groove, said means for selectively clamping including means for pulling said second bracket member down against said base in clamped relation, said means for pulling including a threaded bore in said second slide portion and a screw threadably housing in said threaded bore, said screw including a head portion engageable with said base and adapted to clamp said second bracket member to said base.

2. A merchandise display rack as set forth in claim 1 wherein said groove bottom wall includes a linear slot and wherein said screw extends upwardly through said slot into said means defining said threaded bore.

3. A merchandise display rack as set forth in claim 1 wherein said bottom wall includes an upper surface defining a plurality of ridges extending transversely to said side walls, and wherein said first slide portion includes a lower surface having a plurality of ridges adapted to engage said ridges of said bottom wall and wherein said second slide portion includes a lower surface having a plurality of ridges adapted to be engaged with said ridges of said bottom wall.

4. A merchandise display rack as set forth in claim 1 wherein said first bracket member housing portion defines a chamber having an opening facing said second bracket member and wherein said second bracket member housing portion defines a chamber having an opening facing said first bracket member.

* * * * *